US011389811B2

(12) United States Patent
Kishimoto et al.

(10) Patent No.: US 11,389,811 B2
(45) Date of Patent: Jul. 19, 2022

(54) ELECTROSTATIC COATING DEVICE

(71) Applicant: HONDA MOTOR CO., LTD., Tokyo (JP)

(72) Inventors: Naoki Kishimoto, Tochigi-ken (JP); Hirofumi Mima, Tochigi-ken (JP); Takeshi Nabeta, Tochigi-ken (JP); Koji Shido, Tochigi-ken (JP); Yuta Nagatomo, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 294 days.

(21) Appl. No.: 16/496,484

(22) PCT Filed: Mar. 30, 2018

(86) PCT No.: PCT/JP2018/013679
§ 371 (c)(1),
(2) Date: Sep. 23, 2019

(87) PCT Pub. No.: WO2018/181917
PCT Pub. Date: Oct. 4, 2018

(65) Prior Publication Data

US 2020/0316622 A1 Oct. 8, 2020

(30) Foreign Application Priority Data

Mar. 30, 2017 (JP) ..... JP2017-068238

(51) Int. Cl.
*B05B 5/03* (2006.01)
*B05B 5/04* (2006.01)

(52) U.S. Cl.
CPC . *B05B 5/03* (2013.01); *B05B 5/04* (2013.01)

(58) Field of Classification Search
None
See application file for complete search history.

(56) References Cited

U.S. PATENT DOCUMENTS 9,687,863 B2 6/2017 Matsumoto
10,441,961 B2 10/2019 Kikuchi et al.
(Continued)

FOREIGN PATENT DOCUMENTS

JP 4726188 7/2011

OTHER PUBLICATIONS

Chinese Office Action for Chinese Patent Application No. 201880022642.8 dated Sep. 30, 2020.

*Primary Examiner* — Jethro M. Pence
(74) *Attorney, Agent, or Firm* — Amin, Turocy & Watson, LLP

(57) ABSTRACT

An electrostatic coating device is provided with a housing, which has a cascade housing section that houses a cascade, and a motor housing section that houses an air motor. A clearance between the cascade and the inner wall of a first housing hole forms a first air flow passage. Furthermore, an annular clearance between the air motor (specifically, an air turbine) and the inner wall of a motor chamber forms a second air flow passage. The first air flow passage and the second air flow passage are communicated with each other via, for instance, a third air flow passage that includes a first communication passage, a circular recessed section, a second communication passage, and a third communication passage.

4 Claims, 4 Drawing Sheets

(56) References Cited

U.S. PATENT DOCUMENTS

| | | | | |
|---|---|---|---|---|
| 2009/0020635 | A1 | 1/2009 | Yasuda | |
| 2012/0031329 | A1* | 2/2012 | Sakakibara | B05B 5/001 118/626 |
| 2015/0217306 | A1* | 8/2015 | Matsumoto | B05B 3/1007 118/323 |
| 2017/0106382 | A1* | 4/2017 | Kikuchi | B05B 5/1616 |

* cited by examiner

ELECTROSTATIC COATING DEVICE

TECHNICAL FIELD

The present invention relates to an electrostatic coating device that atomizes electrically charged coating material and blows the same to a target of coating (a workpiece).

BACKGROUND ART

An electrostatic coating device includes a voltage generating unit for generating a voltage to be applied to coating material supplied from a coating material source, a rotary atomizing head for ejecting electrically charged coating material, and an air motor, the voltage generating unit and the air motor being accommodated in a housing (see Japanese Patent No. 4726188, for instance). The air motor is driven with supply of driving air to a turbine, thereby rotating the rotary atomizing head. The coating material is accompanied by sprayed air discharged from the periphery of the rotary atomizing head and flies in the form of mist to the workpiece.

When driving air is introduced into a motor chamber in which the air motor is accommodated, the temperature of the driving air rapidly drops due to adiabatic expansion. This causes the wall surfaces of the motor chamber and the surrounding atmosphere to be cooled, possibly resulting in dew condensation. In the event of such a situation, water droplets attach to the workpiece with coating material, contributing to reduction in the coating quality.

Thus, Japanese Patent No. 4705100 proposes an arrangement for preventing dew condensation.

SUMMARY OF INVENTION

The conventional art described in Japanese Patent No. 4705100 requires formation of a flow passage for insulating air separately from a flow passage for driving air. Accordingly, it involves complicated structures of the air flow passages and hence of the electrostatic coating device, leading to increase in its size.

A general object of the present invention is to provide an electrostatic coating device having a housing of a simple structure.

A major object of the present invention is to provide an electrostatic coating device capable of preventing dew condensation by means of air circulating in the housing.

According to an embodiment of the present invention, provided is an electrostatic coating device including a voltage generating unit configured to generate a voltage to be applied to coating material, an air motor configured to rotate a rotary atomizing head configured to eject the coating material, and a housing configured to house the voltage generating unit and the air motor. The housing has a first air flow passage surrounding the voltage generating unit, a second air flow passage externally surrounding an air turbine which is a component of the air motor, and a third air flow passage through which the first air flow passage and the second air flow passage communicate with each other.

In this manner, the present invention causes air that purges around the voltage generating unit to flow into the second air flow passage so that the air turbine of the air motor is covered by the air flowing through the second air flow passage. In other words, an air curtain is formed around the air turbine. Due to the presence of this air curtain, transfer of the heat of wall surfaces of the motor chamber or of the atmosphere to driving air is avoided even if adiabatic expansion occurs when driving air is introduced into the motor chamber in the housing in order to drive the air motor.

Accordingly, dew condensation is prevented. Therefore, attachment of water droplets to the workpiece with coating material and resulting reduction in the coating quality or the like can be avoided.

Besides, in this case, the air curtain can be formed with air used for purging the voltage generating unit, thus eliminating the necessity to newly form a passage for directing air to the second air flow passage. Accordingly, complication of the air passages can be avoided. That is, the structure of the electrostatic coating device can be simplified and also increase in its size can be avoided.

In a case where the housing has a voltage generating unit housing section configured to house the voltage generating unit, and an air motor housing section configured to house the air motor, the third air flow passage is preferably configured to pass through a point of coupling between the voltage generating unit housing section and the air motor housing section. This is because occurrence of dew condensation or electrolytic corrosion in valves provided at the point of coupling can be avoided.

Further, the third air flow passage may be configured to pass around a valve provided in a coating material supply passage through which the coating material is supplied.

Further, the housing may have a discharge port from which air that has flowed through the second air flow passage is discharged. This can facilitate disposal of air.

According the present invention, an air curtain is formed around the air turbine with air that has purged the voltage generating unit during performing of electrostatic coating (during driving of the air motor). That is, an air curtain is present between the air turbine and the atmosphere. This avoids transfer of the heat of wall surfaces of the motor chamber and the surrounding atmosphere to driving air that has adiabatically expanded, and as a result, dew condensation is prevented. Therefore, attachment of water droplets to the workpiece and resulting reduction in the coating quality are avoided.

Besides, since air that has purged the voltage generating unit is introduced into the second air flow passage, it is not necessary to newly form a passage for directing air to the second air flow passage. Accordingly, complication of the air passages is avoided, so that the electrostatic coating device can be simplified in structure and increase in the size of the electrostatic coating device can be avoided as well.

DESCRIPTION OF EMBODIMENTS

The electrostatic coating device according to the present invention is described in detail below by showing the preferred embodiment thereof and with reference to the accompanying drawings.

Figure 1:
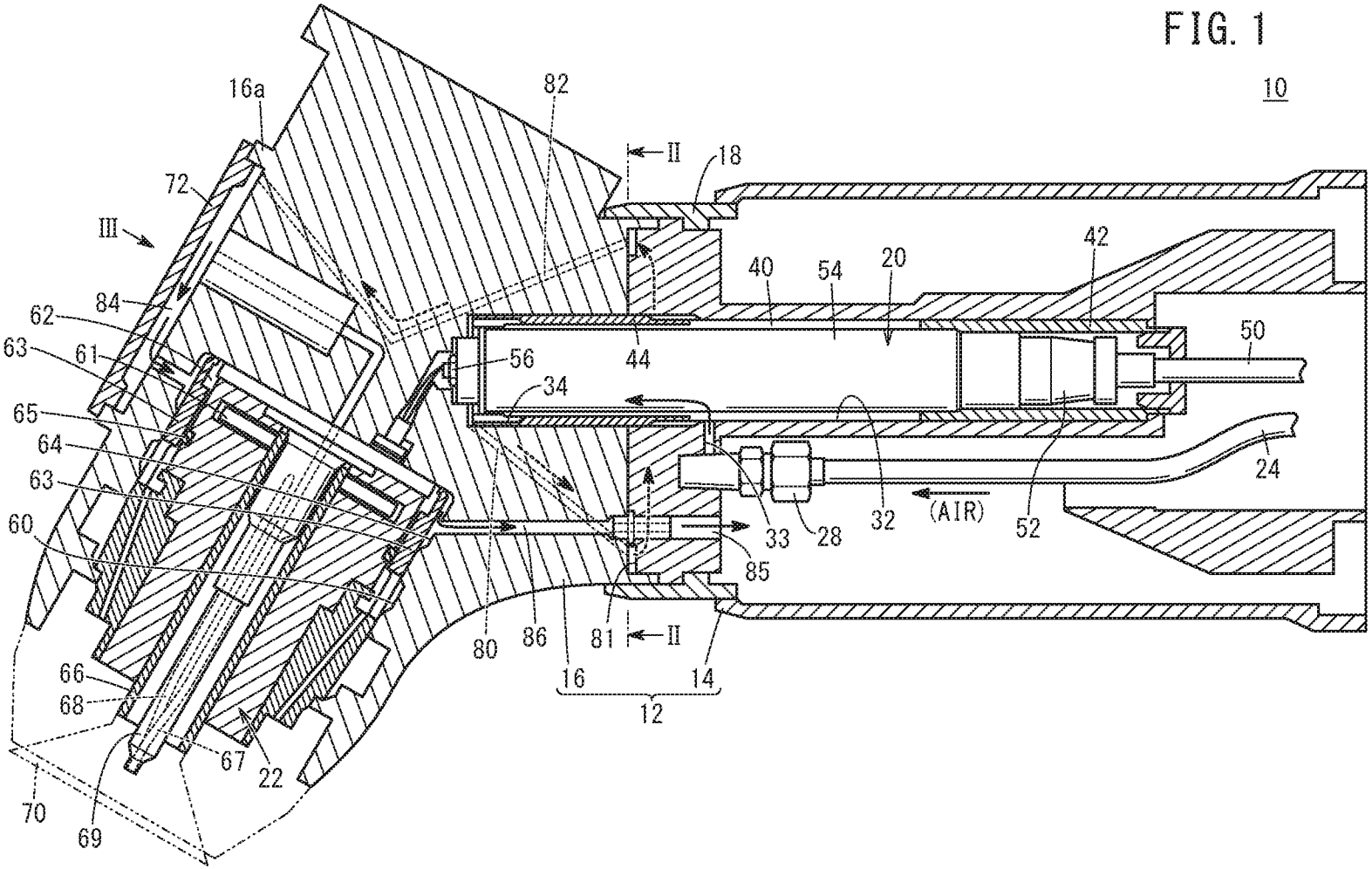
FIG. 1 is a schematic cross-sectional view of relevant portions of an electrostatic coating device according to an embodiment of the present invention.

FIG. 1 is a schematic cross-sectional view of relevant portions of an electrostatic coating device 10 according to an embodiment. This electrostatic coating device 10 is provided at a tip arm of an articulated robot, not illustrated, and blows coating material to a workpiece, such as an automobile body not illustrated, after the articulated robot performed appropriate operations.

The electrostatic coating device 10 includes a housing 12 made of resin. More specifically, the housing 12 has a cascade housing section 14 (voltage generating unit housing section) extending substantially linearly, and a motor housing section 16 (air motor housing section) attached so as to be slightly inclined relative to the cascade housing section 14, and the housing 12 is assembled by the coupling of the cascade housing section 14 and the motor housing section 16 via a coupling ring 18. The cascade housing section 14 houses a cascade 20 serving as a voltage generating unit and the motor housing section 16 houses an air motor 22.

The cascade housing section 14 is hollow and houses a purging air supply tube 24. The purging air supply tube 24 is connected to an air source, not illustrated, via a fitting 28.

The cascade housing section 14 has a long first housing hole 32. The purging air supply tube 24 and the first housing hole 32 are in communication with each other via a communication hole 33. On the other hand, the motor housing section 16 has a relatively short second housing hole 34, and the second housing hole 34 is continuous with the first housing hole 32.

The cascade 20 is housed in the first housing hole 32 and the second housing hole 34 thus being continuous. A given clearance is formed between the first housing hole 32 and the second housing hole 34, and the cascade 20. This clearance serves as a first air flow passage 40. That is, the purging air supply tube 24 is connected to the first air flow passage 40 via the communication hole 33. The cascade 20 is positioned and fixed in the first housing hole 32 and the second housing hole 34 via buffer materials 42, 44.

The cascade 20 has a voltage generating section 52 with which a low-voltage cable 50 is connected, a voltage boosting section 54 containing a step-up transformer for increasing a voltage generated in the voltage generating section 52, and an output terminal 56 for outputting the increased voltage (high voltage). That is, a relatively low voltage generated in the voltage generating section 52 is increased in the voltage boosting section 54, after which the high voltage is applied to coating material via the output terminal 56.

Figure 2:
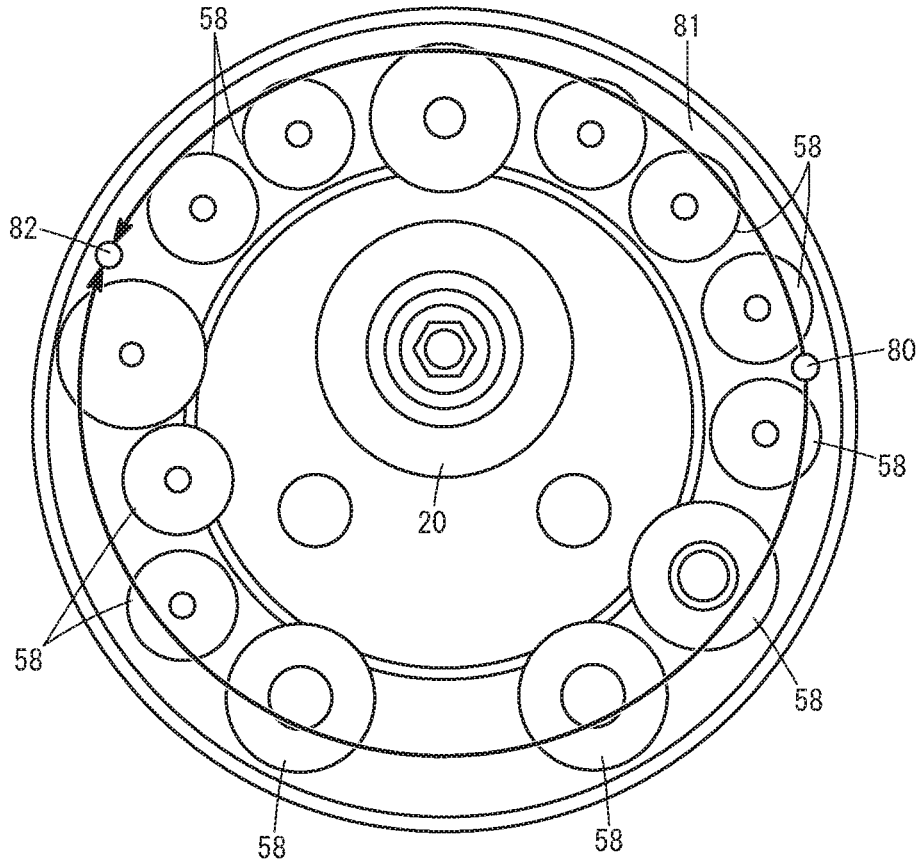
FIG. 2 is a cross-sectional view seen from the arrows at line II-II in FIG. 1.

At a coupling portion of the cascade housing section 14 that is coupled with the motor housing section 16, multiple docking valves 58 are provided as shown in FIG. 2, which is a cross-sectional view seen from the arrows at line II-II in FIG. 1. The docking valves 58 are valves that permit or block communication between various air channels and the like provided on the side of the cascade housing section 14, including the purging air supply tube 24, and various air channels (for example, an air discharge passage) and the like provided on the side of the motor housing section 16.

A motor chamber 60 is formed inside the motor housing section 16, with the air motor 22 housed in the motor chamber 60. A portion of the inner wall of the motor chamber 60 is cut away in an annular shape such that a given annular clearance is formed between the cut-away portion and a wall 63 for forming an exhaust passage 62 in which driving air discharged from an air turbine 61 flows. This annular clearance serves as a second air flow passage 64. Between the air motor 22 and the wall 63, an O-ring 65 for sealing therebetween is provided.

The air motor 22 has a hollow shaft 66 provided with the air turbine 61, and a feed tube 69 provided with a coating material supply passage 67 and a cleaning fluid supply passage 68 is passed through the hollow interior of the hollow shaft 66. Coating material supplied from a coating material source flows through the coating material supply passage 67, while cleaning fluid supplied from a cleaning fluid source flows through the cleaning fluid supply passage 68.

A rotary atomizing head 70 is attached at the tip of the hollow shaft 66. The air turbine 61 and the hollow shaft 66 rotate at high speed integrally with the rotary atomizing head 70 under the action of driving air supplied from a driving air supply tube, not illustrated.

Figure 3:
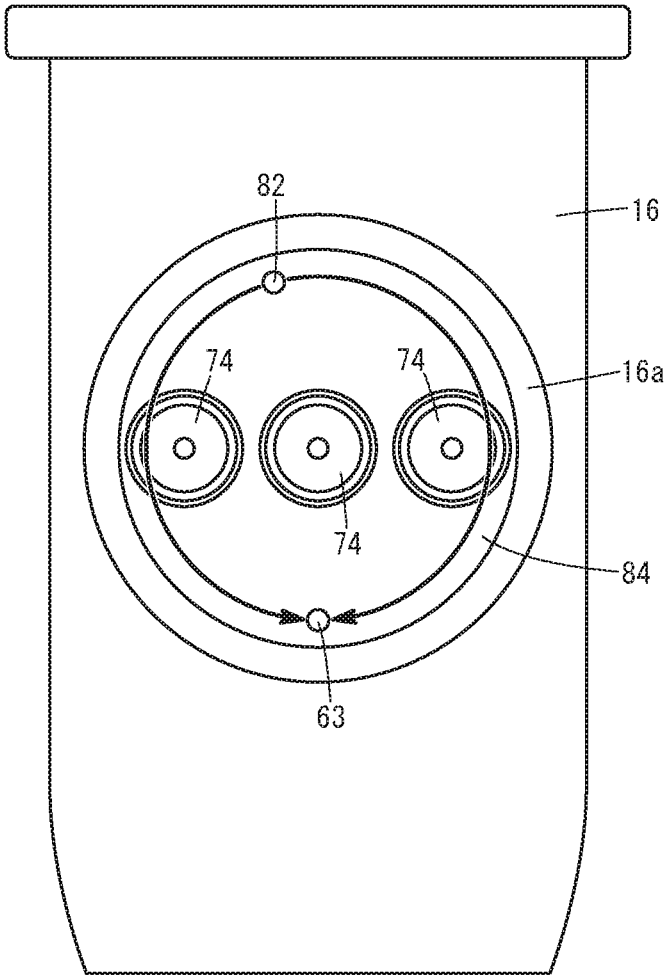
FIG. 3 is an illustration seen from the direction of arrow III in FIG. 1 with a cover member removed.

A cover member 72 is positioned and fixed on an annular projection **16*a* of the motor housing section 16. As shown in FIG. 3, which is an illustration seen from the direction of arrow III in FIG. 1 with the cover member 72 removed, the cover member 72 covers and protects multiple gates 74 (valves) provided in the motor housing section 16. Opening and closing of the respective gates 74 permit and block the communication between the coating material supply passage 67 and the coating material source and between the cleaning fluid supply passage 68 and the cleaning fluid source. Communication between the coating material supply passage 67 and the coating material source and communication between the cleaning fluid supply passage 68** and the cleaning fluid source never occur simultaneously. That is, either one of the coating material and the cleaning fluid is selectively ejected.

The cover member 72 is spaced from the motor housing section 16 by a given distance. That is, a clearance is formed between the cover member 72 and the motor housing section 16. As described later, this clearance (a third communication passage 84) is where compressed air having passed through the first air flow passage 40 and moving toward the second air flow passage 64 flows.

Further, the housing 12 has a first communication passage 80 running from the vicinity of the output terminal 56 in the second housing hole 34 toward the docking valves 58, a circular recess 81 formed around the docking valves 58 between the cascade housing section 14 and the motor housing section 16, a second communication passage 82 running from the docking valves 58 toward the gates 74, a third communication passage 84 running from the gates 74 toward the second air flow passage 64, and a discharge passage 86 running from the second air flow passage 64 to a discharge port 85. Although the housing 12 also has a passage for discharging the driving air in the exhaust passage 62, this passage is not shown in the drawing.

The first air flow passage 40 and the second air flow passage 64 are in communication with each other via the first communication passage 80, the circular recess 81, the second communication passage 82, and the third communication passage 84. That is, the first communication passage 80, the circular recess 81, the second communication passage 82, and the third communication passage 84 serve as a third air flow passage through which the first air flow passage 40 and the second air flow passage 64 communicate with each other. As will be understood from FIGS. 2 and 3, a certain phase difference is provided between the first communication passage 80 and the second communication passage 82 in the circular recess 81 and a certain phase difference is also provided between the openings of the second communication passage 82 and the second air flow passage 64 in the third communication passage 84.

The electrostatic coating device 10 according to this embodiment is basically structured as described above, and the action and effects thereof are now described.

First, compressed air is supplied from the air source. The compressed air is introduced into the first housing hole 32 through the purging air supply tube 24. The compressed air fills the insides of the first housing hole 32 and the second housing hole 34, namely the first air flow passage 40, and covers the entire cascade 20. Thus, the output terminal 56 is also covered by the compressed air.

Figure 4:
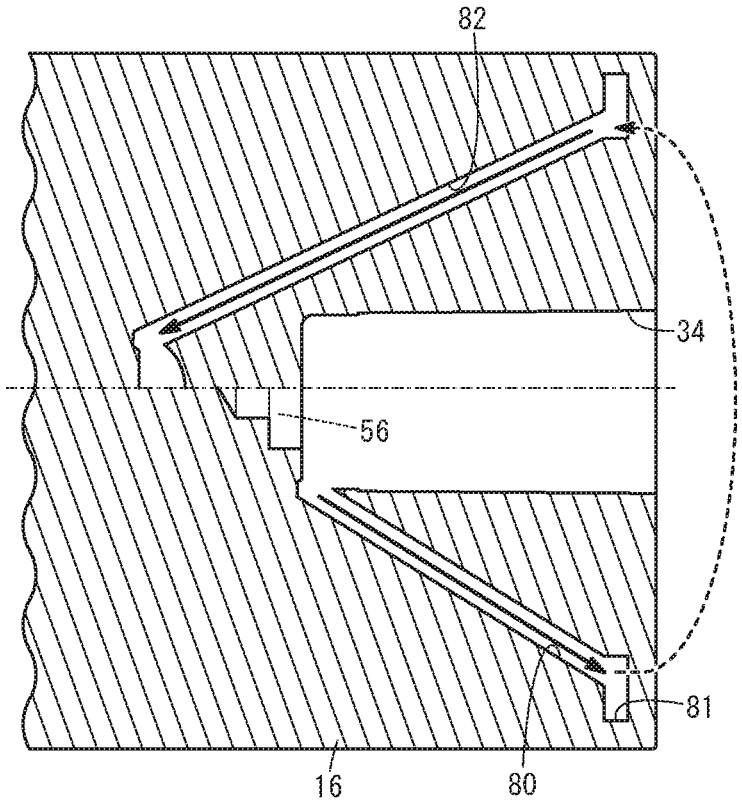
FIG. 4 is a schematic cross-sectional view of relevant portions of a first communication passage, a circular recess, and a second communication passage, which constitute a third air flow passage.

As compressed air is further supplied, excess compressed air enters the first communication passage 80 provided in the vicinity of the output terminal 56 from the second housing hole 34 (the first air flow passage 40), as shown in FIG. 4. The compressed air further moves from the first communication passage 80 toward the docking valves 58, shown in FIG. 2, to enter the circular recess 81. The compressed air then circulates to the opening of the second communication passage 82 having a phase difference. During this process, the surroundings of each docking valve 58 are purged. This prevents dew condensation or electrolytic corrosion from occurring on the docking valves 58.

The compressed air further enters through the opening of the second communication passage 82, flows through the second communication passage 82 formed in the vicinity of the second housing hole 34, and then enters the third communication passage 84 formed between the motor housing section 16 and the cover member 72. Then, while circulating into the opening of the second air flow passage 64 having a phase difference, the compressed air purges around each gate 74.

Subsequently, the compressed air further enters through the opening of the second air flow passage 64 and enters the annular portion of the second air flow passage 64, shown in FIG. 1. Since the second air flow passage 64 is specifically located so as to externally surround the wall 63 near the air turbine 61, the wall 63 and the exhaust passage 62 are surrounded by the compressed air in the second air flow passage 64. In other words, an air curtain is formed around the air turbine 61 and the exhaust passage 62 across the wall 63.

The compressed air that has entered the second air flow passage 64 flows through the discharge passage 86 and is discharged out of the housing 12 from the discharge port 85 formed inside the cascade housing section 14.

As described above, in this embodiment, the compressed air that purges the insides of the first housing hole 32 and the second housing hole 34, in which the cascade 20 is housed, is also used for purging around the docking valves 58 and for purging around the gates 74, and as an air curtain that surrounds the air turbine 61 and the exhaust passage 62. This means that there is no need to separately form an air passage for guiding compressed air supplied from the compressed air source directly into the second air flow passage 64. Besides, in this case, only the third communication passage 84 and the discharge passage 86 need to be provided in an existing electrostatic coating device 10. Accordingly, the flow passage for compressed air is simplified.

For these reasons, the electrostatic coating device 10 can be simplified. That is, complication in the structure of the electrostatic coating device 10 or increase in its size can be avoided.

Meanwhile, driving air is supplied into the motor chamber 60 through the driving air supply tube. Under the action of this driving air, the air turbine 61, which is a component of the air motor 22, starts to rotate at high speed integrally with the hollow shaft 66 and the rotary atomizing head 70.

Furthermore, the cascade 20 is energized. A voltage is generated in the voltage generating section 52 with which the low-voltage cable 50 is connected, is increased in the voltage boosting section 54, and is taken from the output terminal 56 as a high voltage.

Further, pilot air is supplied to the gates 74 via a pilot air supply tube, not illustrated. Each of the gates 74 is formed by detachable insertion of a rod into a port, for example, such that when the rod detaches from the port upon supply of pilot air, coating material is supplied from the coating material source to the coating material supply passage 67. The coating material is subjected to high voltage via the output terminal 56, further atomized with the centrifugal force of the rotary atomizing head 70, and then applied to the workpiece by electrostatic coating.

The driving air that has driven the air turbine 61 circulates to the exhaust passage 62 at relatively low temperature because the driving air has adiabatically expanded. Here, the exhaust passage 62 is surrounded by the air curtain flowing through the second air flow passage 64 across the wall 63. This avoids transfer of the heat of the atmosphere around the motor housing section 16 to the low-temperature driving air in the exhaust passage 62.

As a result, occurrence of dew condensation around the electrostatic coating device 10 and electrolytic corrosion of the air motor 22 is prevented. Therefore, attachment of water droplets to an automobile body with coating material and resulting reduction in the coating quality can be avoided.

During performing of the electrostatic coating, the circulation of compressed air as described above is continued in the first air flow passage 40, the first communication passage 80, the circular recess 81, the second communication passage 82, the third communication passage 84 (the third air flow passage), and the second air flow passage 64. This can avoid degradation of resin-made members, including the cascade housing section 14, electrolytic corrosion of the output terminal 56, and the like. Also, by purging around the docking valves 58 and the gates 74, it is possible to avoid the occurrence of dew condensation or electrolytic corrosion around the docking valves and the gates and remove coating material residue and the like.

When supply of pilot air is stopped, the rod re-enters the port to place the gate 74 in a closed state. This blocks the communication between the coating material source and the coating material supply passage 67, whereby the ejection of coating material is stopped.

In this state, cleaning fluid is ejected into the feed tube 69 from the cleaning fluid source through the cleaning fluid supply passage 68. With this cleaning fluid, the outer periphery of the feed tube 69 is cleaned.

The present invention is not specifically limited to the foregoing embodiment and various modifications are possible without departing from the scope of the present invention.

For example, the first air flow passage 40 and the second air flow passage 64 may be in communication via a single communication passage. In such a case, that communication passage serves as the third air flow passage.

REFERENCE SIGNS LIST

10 electrostatic coating device
12 housing
14 cascade housing section
16 motor housing section
18 coupling ring
20 cascade

22 air motor
32 first housing hole
33 communication hole
34 second housing hole
40 first air flow passage
56 output terminal
58 docking valve
60 motor chamber
61 air turbine
62 exhaust passage
63 wall
64 second air flow passage
67 coating material supply passage
68 cleaning fluid supply passage
69 feed tube
70 rotary atomizing head
72 cover member
74 gate
80 first communication passage
81 circular recess
82 second communication passage
84 third communication passage
85 discharge port
86 discharge passage

What is claimed is:

1. An electrostatic coating device comprising:

a voltage generating unit configured to generate a voltage to be applied to coating material;

an air motor configured to rotate a rotary atomizing head configured to eject the coating material; and a housing configured to house the voltage generating unit and the air motor, wherein the housing has a first air flow passage surrounding the voltage generating unit, a second air flow passage externally surrounding an air turbine which is a component of the air motor, and a third air flow passage through which the first air flow passage and the second air flow passage communicate with each other, a wall is arranged between the housing and the air motor, an exhaust passage in which driving air discharged from the air turbine flows is formed on an inner side of the wall, and the second air flow passage is formed between an inner wall of the housing and an outer wall of the wall, the second air flow passage surrounds an outer side of the air turbine and the exhaust passage via the wall.

2. The electrostatic coating device according to claim 1, wherein the housing includes a voltage generating unit housing section configured to house the voltage generating unit, and an air motor housing section configured to house the air motor, and the third air flow passage passes through a point of coupling between the voltage generating unit housing section and the air motor housing section.

3. The electrostatic coating device according to claim 1, wherein the third air flow passage passes around a valve provided in a coating material supply passage through which the coating material is supplied.

4. The electrostatic coating device according to claim 1, wherein the housing has a discharge port from which air that has flowed through the second air flow passage is discharged.

* * * * *